United States Patent [19]

Voto, Jr. et al.

[11] Patent Number: 4,988,547

[45] Date of Patent: Jan. 29, 1991

[54] SECURITY DEPOSIT BAG

[75] Inventors: Leonard M. Voto, Jr., Forest Lake; Shari J. Wilson, Minneapolis, both of Minn.

[73] Assignee: Minnesota Mining and Manufacturing Company, St. Paul, Minn.

[21] Appl. No.: 354,622

[22] Filed: May 19, 1989

[51] Int. Cl.[5] ..... B65D 33/18

[52] U.S. Cl. ..... 428/35.2; 383/5; 383/84; 428/35.4; 428/343; 428/916

[58] Field of Search ..... 428/35.2, 35.4, 40, 428/343, 352, 354, 916; 383/5, 84

[56] References Cited

U.S. PATENT DOCUMENTS

| | | | |
|---|---|---|---|
| 4,464,158 | 8/1984 | Kardon | 493/265 |
| 4,468,811 | 8/1984 | Shaw et al. | 383/5 |
| 4,483,018 | 11/1984 | Whelan | 383/5 |
| 4,509,196 | 4/1985 | Sak et al. | 383/5 |
| 4,720,040 | 1/1988 | Gurewitz | 232/1 D |
| 4,834,552 | 5/1989 | Makowka | 383/5 |
| 4,838,708 | 6/1989 | Holcomb et al. | 383/5 |

FOREIGN PATENT DOCUMENTS

| | | | |
|---|---|---|---|
| 1380727 | 1/1975 | United Kingdom . | |
| 2032882 | 5/1980 | United Kingdom | 383/5 |
| 2051003B | 1/1981 | United Kingdom . | |
| 2120638A | 12/1983 | United Kingdom . | |
| 2145997A | 4/1985 | United Kingdom . | |

*Primary Examiner*—James Seidleck

*Attorney, Agent, or Firm*—Donald M. Sell; Walter N. Kirn; David L. Weinstein

[57] ABSTRACT

A bag having a front panel and a rear panel having respective side and bottom portions sealed together leaving an opening in the bag for access to the interior thereof. The rear panel extends beyond the opening to form a flap that can be folded over the opening. A first area of adhesive means is carried by the rear panel, i.e., the flap, and is adapted to secure the panels together to close the opening of the bag by bonding to a second area of adhesive means carried by the front panel. Each adhesive means comprises a backing bearing a layer of adhesive on one major surface thereof, and each is bonded to its respective panel by means of the second major surface of said backing, which second major surface is bonded to the material of its respective panel by means of heating, fusing, or the like.

12 Claims, 1 Drawing Sheet

Fig. 1
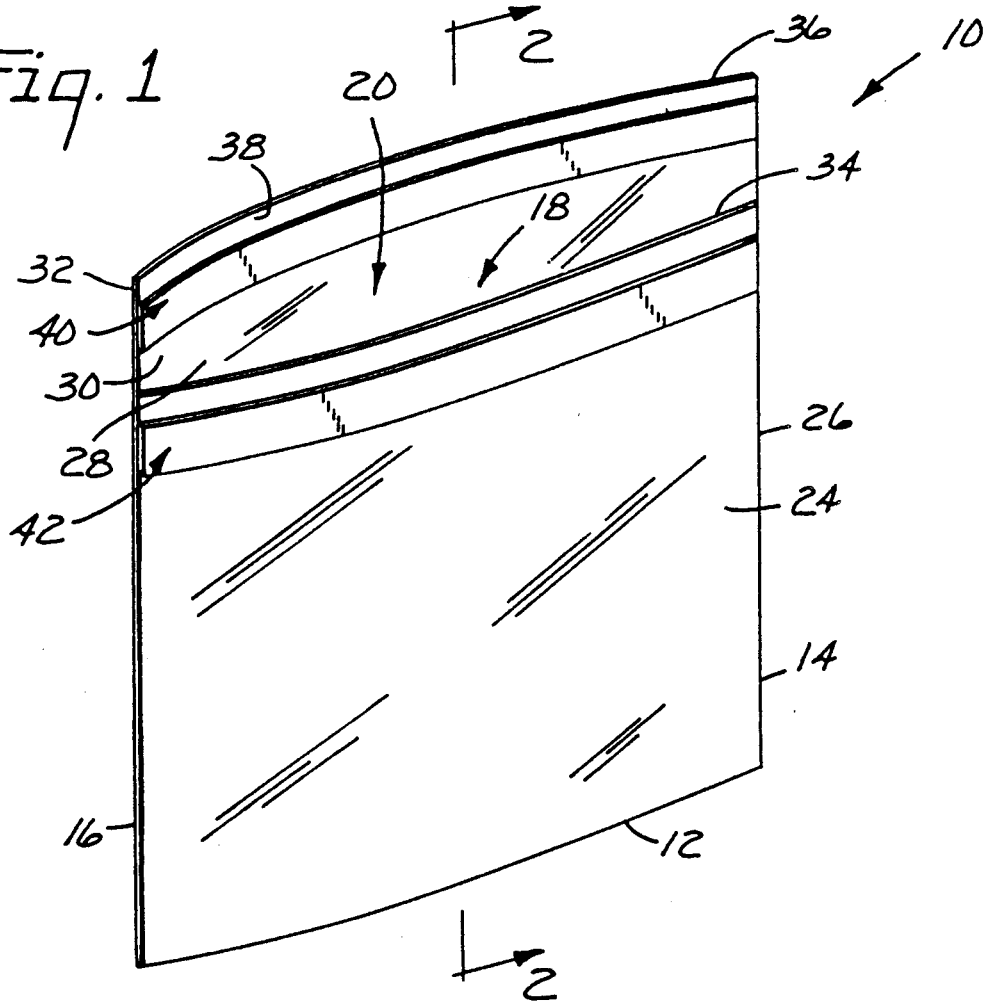
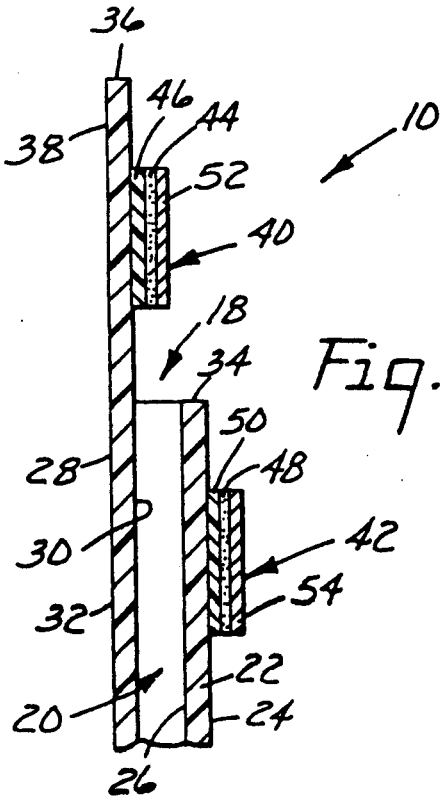
Fig. 2
Fig. 3
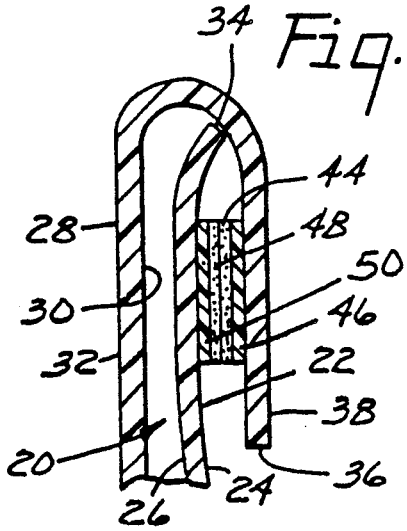

SECURITY DEPOSIT BAG

BACKGROUND OF THE INVENTION

1. Field of the Invention

This invention relates to bags, and, more particularly, to bags for secure deposit of articles.

2. Discussion of the Art

Security deposit bags are used to securely store and transport valuable articles such as documents, cash and currency, checks, jewelry, bank deposits, securities, criminal investigation evidence, and the like. Typically, security deposit bags include bags or envelopes constructed from sewn fabric, plastic film, or laminates thereof with a zippered closure. The zippered closure may be secured with a lock or seal. However, such conventional security deposit bags are bulky and expensive, and although they are reusable, they also generate a recurring expense in transporting the security deposit bag back to the sender for reuse.

Disposable security deposit bags that are adhesively secured and sealed have also been developed. U.K. Patent Application No. GB 2145997A, entitled "Tamperproof Bag", illustrates one such disposable bag, which is constructed of polyethylene. An adhesive strip is applied to an inside surface of the bag adjacent the opening and is temporarily covered by a liner. Once the bag has been filled, the liner is removed and the bag sealed by the adhesive strip. The bond of the adhesive strip exceeds the strength of the plastic film used to construct the bag. Any attempt to open the bag will result in destruction or visible distortion of the bag material, thus indicating that the bag has been opened. In another embodiment in U.K. Patent Application No. GB 2145997A, the bag comprises a flap that is intended to be folded over the opening to form a second seal. U.K. Patent Application No. GB 2120638A discloses a plastic security bag having one or more lines of adhesive extending from both edges of the bag inside the bag in such a way that the bag can be completely sealed against egress of contents. Although the security deposit bags disclosed in U.K. Patent Application Nos. GB 2145997A and GB 2120638A are improvements over other conventional security deposit bags, they still exhibit several undesirable characteristics. It has been found that by subjecting the adhesive seal of the bag to extremely low temperature, e.g., −45° C., by means of dry ice or dichlorodifluoromethane ("Freon"), the adhesive becomes non-tacky, thereby allowing the adhesive to become unsealed from the polyethylene layer to which it has been applied. One can then tamper with the contents of the package and finally reseal the bag when the adhesive reaches ambient temperature.

SUMMARY OF THE INVENTION

The present invention provides a bag having a front panel and a rear panel having respective side and bottom portions sealed together leaving an opening in the bag for access to the interior thereof. The rear panel extends beyond the opening to form a flap that can be folded over the opening. A first area of adhesive means is carried by the rear panel and is adapted to secure the panels together to close the opening of the bag by bonding to a second area of adhesive means carried by the front panel. The first adhesive means comprises a backing bearing a layer of adhesive on one major surface thereof, and the first adhesive means is secured to the rear panel by means of the second major surface of said backing, which second major surface is bonded to the material of the rear panel by means of heating, fusing, or the like. The second adhesive means comprises a backing bearing a layer of adhesive on one major surface thereof, and the second adhesive means is secured to the front panel by means of the second major surface of said backing, which second major surface is bonded to the material of the front panel by means of heating, fusing, or the like.

The material of the backing and the material of both the front and the rear panel must be compatible so that the bond between them can be formed by heating, fusing, or the like.

The security deposit bag of this invention is inexpensive, disposable, and capable of indicating tampering by including an adhesive closure means that provides an unambiguous indication, externally of the bag, that the bag has been sealed and reopened. The use of an appropriate adhesive will allow indication of tampering even when the adhesive has been subjected to temperatures as low as −45° C.

BRIEF DESCRIPTION OF THE DRAWINGS

The present invention will be further described with reference to the accompanying drawings wherein like reference numerals refer to like parts in the several views, and wherein:

FIG. 1 is a perspective view of a security deposit bag constructed according to this invention with adhesive closure strips adhered to the first and second panels;

FIG. 2 is a sectional view through the security bag of FIG. 1 taken along line 2—2, before the bag has been sealed; and FIG. 3 is a sectional view through the security bag of FIG. 1 taken along line 2—2, after the bag has been sealed.

DETAILED DESCRIPTION

Referring now to FIGS. 1, 2, and 3, reference numeral 10 generally indicates a security deposit bag constructed according to the present invention. The security deposit bag is in the form of a flexible bag, envelope or the like, constructed of a strong, lightweight polymeric, heat-sealable material such as polyethylene, polypropylene, polyethylene terephthalate, polyvinylchloride, polyvinylidenechloride, vinyl acetate copolymers, mixtures of the foregoing, multilayer films of the foregoing, and other polymers and copolymers. The bag of this invention may be considered disposable upon removal of the contents of the bag. Bag 10 can be formed by folding over a rectangular sheet of material and sealing it along its sides. The bag thus formed includes bottom 12, right side 14, left side 16, and opening 18 providing access to interior 20 of bag 10. Front panel 22 includes front and rear major surfaces 24 and 26, respectively. Rear panel 28 includes front and rear major surfaces 30 and 32, respectively. Although not shown, bag 10 may also be constructed with side and bottom panels, in addition to the front and rear panels illustrated.

The bag can be formed of a single sheet of film folded on itself to form panels 22 and 28, with the sides being closed by means of heat-sealing. Alternatively, the bag can be formed of two sheets of film by heat-sealing the edges and bottom of one panel 22 to the corresponding edges and bottom of the other panel 28.

Because end edge 34 of front panel 22 and end edge 36 of rear panel 28 of bag 10 are not aligned, flap 38 is formed by a portion of rear panel 28. Flap 38 is provided to cover and seal opening 18 by folding front surface 30 of rear panel 28 over into contact with front surface 24 of front panel 22 so that first area of adhesive means 40 can be caused to come into contact with second area of adhesive means 42 to adhesively secure rear panel 28 to front panel 22 so as to seal opening 18.

First adhesive means 40 is preferably provided by applying a layer of pressure-sensitive adhesive 44 to one major surface of a backing 46 formed from a polymeric material compatible with the material of rear panel 28. The surface of backing 46 not bearing layer 44 of pressure-sensitive adhesive is then bonded to rear panel 28 by means of heating, fusing, or the like. Means for heat sealing are well-known. One means of fusing is ultrasonic welding. In like manner, second adhesive means 42 is preferably provided by applying a layer of pressure-sensitive adhesive 48 to one major surface of a backing 50 formed from a polymeric material compatible with the material of front panel 22. The surface of backing 50 not bearing layer 48 of pressure-sensitive adhesive is then bonded to front panel 22 by means of heating, fusing, or the like. As used herein, the term "compatible" means capable of being fused together, as by heat. Backing 46 and backing 50 are preferably made from a material selected from the group consisting of polyethylene, polypropylene, polyethylene terephthalate, polyvinylchloride, polyvinylidenechloride, vinyl acetate copolymers, and mixtures of the foregoing.

Any attempt to detach flap 38 from front panel 22 will result in destruction of bag 10 in the area of backing 46 or backing 50.

The following is a non-exclusive list of adhesives suitable for use in forming adhesive layer 44 of first adhesive means 40 and in forming adhesive layer 48 of second adhesive means 42: styrene-isoprene-styrene block copolymers or styrene-butadiene-styrene block copolymers or both with hydrocarbon and/or terpene tackifiers, synthetic or natural rubbers with tackifiers, acrylic polymers with or without tackifiers, ethylene-acrylic acid copolymers, ethylene-vinyl acetate copolymers, and polyethylene.

A liner 52 can be releasably adhered to adhesive layer 44 opposite backing 46. Liner 52 should be coextensive with layer 44 of adhesive. Liner 52 can be constructed of any material suitable for use with the particular adhesive applied to the second major surface of the film backing strip such as a silicone coated or polymer-coated paper or plastic film. In like manner, a liner 54 can be releasably adhered to adhesive layer 48 opposite backing 50. Line 54 should be coextensive with layer 48 of adhesive. Liner 54 can be constructed of any material suitable for use with the particular adhesive applied to the first major surface of the film backing strip, such as silicone-coated or polymer-coated paper or plastic film.

There are several essential relationships between the bond strength of the adhesive-to-adhesive bond between adhesive layers 44 and 48, the bond strength of the bond between backing 50 and front panel 22, the bond strength of the bond between backing 46 and flap 38 and the tear strength of backings 46 and 50.

In general, the bond strength of the aforementioned adhesive-to-adhesive bond must be greater than the bond strength of the aforementioned backing-to-panel bond and backing-to-flap bond. If the adhesive-to-adhesive bond strength were less than the backing-to-panel or backing-to-flap bond strengths, the adhesive layers could be pulled apart while the backing-to-panel bond and backing-to-flap bond would still remain intact, thereby failing to indicate a breach of the security of the package. Further, the adhesive-to-adhesive bond strength is preferably greater than the tear strength of the backings. If the adhesive-to-adhesive bond strength were less than the tear strength of the backings, the adhesive layers could be pulled apart without distorting the backings, thereby failing to indicate a breach of security of the bag.

For purposes of security, it is desirable to minimize the "dwell time" required for the layers of adhesive to develop a sufficiently high bond strength. Preferably, the dwell time is no greater than 0–15 seconds. This precludes or minimizes the risk of undetected opening of the bag prior to the attainment of ultimate bond strengths of the layers of adhesive. The dwell time may be reduced by proper selection of adhesives.

It is preferred to use polyethylene as the material for front panel 22, rear panel 28, and flap 38, for the reasons that it is light in weight, which leads to lower shipping costs, and it resists damage, such as tearing, upon storage. It is also preferred to use polyethylene as the material for backings 46 and 50, for the reasons that it is heat-sealable and that it is compatible with the polyethylene material of rear panel 28. It is preferred to use styrene-isoprene-styrene block copolymer as the adhesive for layer 44, and it is preferred to use styrene-isoprene-styrene block copolymer as the adhesive for layer 48. In the foregoing preferred embodiment, it is preferred that panels 22, 28 and flap 38 have thickness of from about 3 mils (0.076 mm) to about 5 mils (0.127 mm); it is preferred that backings 46 and 50 have a thickness of from about 20 to about 33% of the thickness of panels 28 and 22, respectively.

The following non-limiting example will further illustrate the bag of this invention.

EXAMPLE 1

An adhesive solution suitable for coating was prepared by mixing the following ingredients in the amounts indicated:

| Ingredient | Amount (parts by weight) |
|---|---|
| Styrene-isoprene-styrene block copolymer ("Kraton" 1107, Shell Chemical Co.) | 100 |
| Tackifying resin ("Nevtac" 100, Neville Chemical Co.) | 78.31 |
| Titanium dioxide | 4.88 |
| Antioxidant ("Ethanox" 330, Ethyl Corporation) | 1.71 |
| Toluene | 227.27 |

The foregoing solution was coated onto silicone-coated paper liners and allowed to dry. The dried coatings had a thickness of 1.3 mil (0.033 Then strips of low density polyethylene film (thickness of 1.0 mil (0.025 surface tension of 40 dynes/cm$^2$) were laminated to the layers of adhesive borne on the liners.

A bag was formed of a single sheet of polyethylene film having the dimension 68 cm (length)×30.5 cm (width)×3.5 mil (0.089 mm)(thickness). The bag was formed by folding the sheet so as to provide a flap portion having the dimensions 30.5 cm×7 cm and a pouch - portion having the dimensions 30.5 cm×30.5 cm. The sides of the bag were closed by means of heat sealing.

One strip of the previously described tape was bonded to the flap portion of the bag and another strip of the tape was bonded to the pouch portion of the bag. Bonding of both strips of tape was effected by heat sealing.

An article was placed in the pouch portion, the silicone-coated paper liners were removed from the adhesive layers, the flap was folded over the opening in the pouch so that the adhesive layers would contact one another, and the flap was sealed to the pouch by means of hand pressure.

Upon attempts to unseal the bag at the point of contact of the adhesive layers, the bag was distorted. Access to the contents of the bag was possible only by means of cutting or tearing, thereby indicating tampering.

At low temperatures that were reached by means of cooling with "Freon" ("Component Coolant", Radio Shack), attempts to open the bag resulted in severe distortion of the material of the bag, thereby indicating tampering.

COMPARATIVE EXAMPLE A

A bag was formed of a single sheet of polyethylene film having the dimension 68 cm (length)×30.5 cm (width)×3.5 mil (0.089 mm)(thickness). The bag was formed by folding the sheet so as to provide a flap portion having the dimensions 30.5 cm×7 cm and a pouch portion having the dimensions 30.5 cm×30.5 cm. The sides of the bag were closed by means of heat sealing.

"Scotch" Brand double-coated tape #443 was used as a means for closing the aforementioned bag. One strip of the double-coated tape was applied to the flap portion. Another strip of the double-coated tape was applied to the pouch portion of the bag. Bonding of both strips of tape was effected by adhesion alone.

An article was placed in the pouch portion, the silicone-coated paper liners were removed from the adhesive layers, the flap was folded over the opening in the pouch so that the adhesive layers would contact one another, and the flap was sealed to the pouch by means of hand pressure.

Upon attempts to unseal the bag immediately at room temperature, the bag showed severe deformation. Access to the contents of the bag was possible only by means of cutting or tearing, thereby indicating tampering. However, when "Freon" ("Component Coolant", Radio Shack) was sprayed directly onto the closure, the adhesive froze, destroying the seal, and allowing the bag to open very easily with no deformation whatsoever. The adhesive released from the bag surface, allowing access to the contents of the bag. Upon warming the adhesive to room temperature, it regained its tackiness and could hold the bag closed without showing any sign of tampering.

Various modifications and alterations of this invention will become apparent to those skilled in the art without departing from the scope and spirit of this invention, and it should be understood that this invention is not to be unduly limited to the illustrative embodiments set forth herein.

We claim:

1. A bag comprising a front panel formed of a polymeric heat-sealable material and a rear panel formed of a polymeric heat-sealable material, said front panel and rear panel having respective side and bottom portions sealed together leaving an unsealed end of said front panel, said rear panel extending beyond the unsealed end of said front panel to form a flap foldable over said unsealed end of said front panel, said flap having disposed thereon a first area of adhesive means, said front panel having disposed thereon a second area of adhesive means coextensive with said first area of adhesive means when said flap is folded so as to close said bag, said first area of adhesive means bonded by means by heating, fusing, or the like, to said flap by means of a first backing made of polymeric heat-sealable material compatible with the material of said flap, said second area of adhesive means bonded by means of heating, fusing, or the like to said front panel by means of a second backing made of polymeric heat-sealable material compatible with the material of said front panel, said first area of adhesive means and said second area of adhesive means capable of forming a bond having a bond strength greater than.

(a) the strength of the second backing-to-front panel bond, (b) the strength of the first backing-to-flap bond, (c) the tear strength of the first backing, and (d) the tear strength of the second backing.

2. The bag of claim 1, wherein said first backing is bonded to said flap by means of heating.

3. The bag of claim 1, wherein said second backing is bonded to said front panel by means of heating.

4. The bag of claim 1, wherein said first area of adhesive means comprises a layer of pressure-sensitive adhesive.

5. The bag of claim 1, wherein said second area of adhesive means comprises a layer of pressure-sensitive adhesive.

6. The bag of claim 4, wherein said pressure-sensitive adhesive is a styrene-isoprene-styrene block copolymer.

7. The bag of claim 5, wherein said pressure-sensitive adhesive is a styrene-isoprene-styrene block copolymer.

8. The bag of claim 1, wherein said first backing is a film made from a polymeric heat-sealable material.

9. The bag of claim 8, wherein said first backing is made from a material selected from the group consisting of polyethylene, polypropylene, polyethylene terephthalate, polyvinylchloride, polyvinylidenechloride, vinyl acetate copolymers, and mixtures of the foregoing.

10. The bag of claim 1, wherein said second backing is a film made from a polymeric heat-sealable material.

11. The bag of claim 10, wherein said second backing is made from a material selected from the group consisting of polyethylene, polypropylene, polyethylene terephthalate, polyvinylchloride, polyvinylidenechloride, vinyl acetate copolymers, and mixtures of the foregoing.

12. The bag of claim 1, wherein said front panel, said rear panel, and said flap are made from a material selected from the group consisting of polyethylene, polypropylene, polyethylene terephthalate, polyvinylchloride, polyvinylidenechloride, vinyl acetate copolymers, and mixtures of the foregoing.

* * * * *